US006478597B1

(12) United States Patent
Roberts et al.

(10) Patent No.: US 6,478,597 B1
(45) Date of Patent: Nov. 12, 2002

(54) ZERO INSERTION FORCE CONNECTOR FOR FLAT FLEXIBLE CABLE

(75) Inventors: Joseph A. Roberts, Hudson, NH (US); Jonathan F. Roberts, Litchfield, NH (US)

(73) Assignee: Miraco, Inc., Manchester, NH (US)

( * ) Notice: Subject to any disclaimer, the term of this patent is extended or adjusted under 35 U.S.C. 154(b) by 0 days.

(21) Appl. No.: 09/931,459

(22) Filed: Aug. 16, 2001

(51) Int. Cl.[7] ..... H01R 13/15; H01R 12/24
(52) U.S. Cl. ..... 439/260; 439/495
(58) Field of Search ..... 439/260, 258, 439/342, 331, 492, 493, 499, 495

(56) References Cited

U.S. PATENT DOCUMENTS 3,883,207 A * 5/1975 Tomkiewicz ..... 439/264
5,542,855 A * 8/1996 Asai ..... 439/260
5,934,932 A * 8/1999 Ito ..... 439/495
6,019,521 A * 2/2000 Manning et al. ..... 385/56

* cited by examiner

*Primary Examiner*—Tulsidas Patel
*Assistant Examiner*—Chandrika Prasad
(74) *Attorney, Agent, or Firm*—Davis & Bujold, P.L.L.C.

(57) ABSTRACT

A zero insertion force (ZIF) connector for connecting a flat flexible cable (FFC) to contacts of a printed circuit board (PCB) comprising first and second housings which are relatively moveable between an unlocked state in which an FFC may be freely inserted into the housings for engagement with the contacts and a locked state in which the conductors of the FFC are captively engaged in electrical contact with the contacts; a latch system interconnecting the housing to latch the housings in their unlocked and locked state; and contact and FFC conductor guidance ribs sized and spaced to align the FFC conductors and the contacts for electrical connection of each conductor with an associated contact.

18 Claims, 8 Drawing Sheets

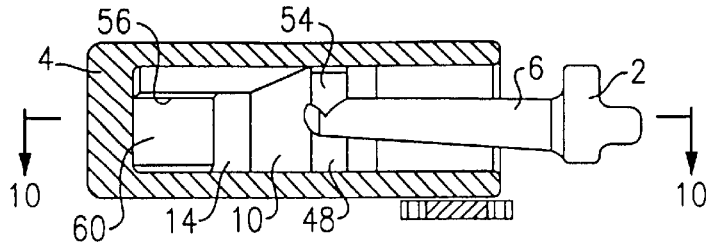
FIG.8
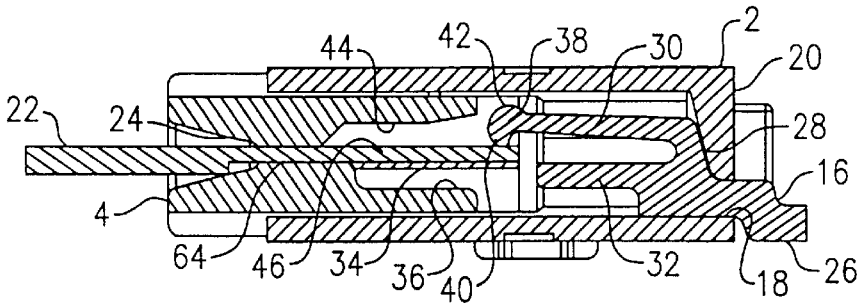
FIG.9A
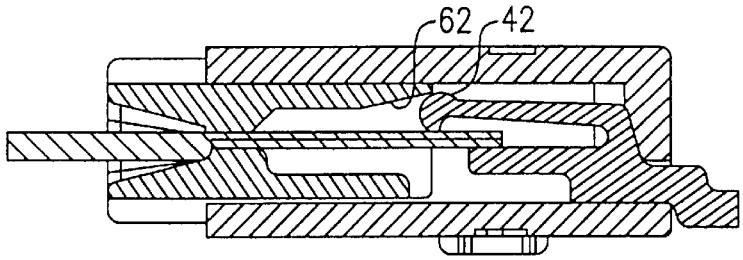
FIG.9B
FIG.10
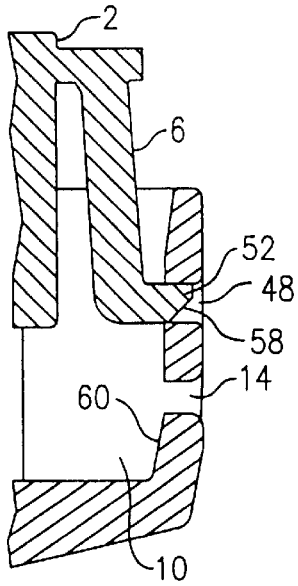

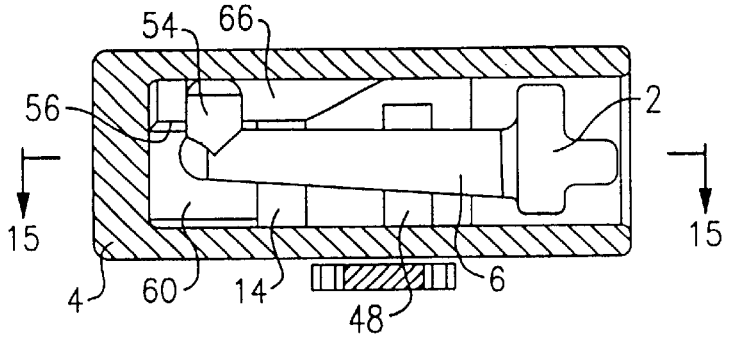
FIG.13
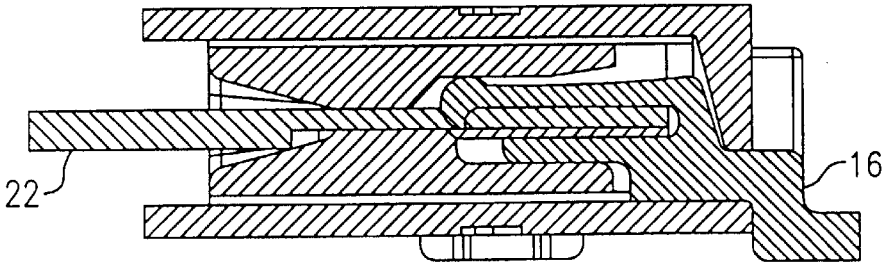
FIG.14
FIG.15
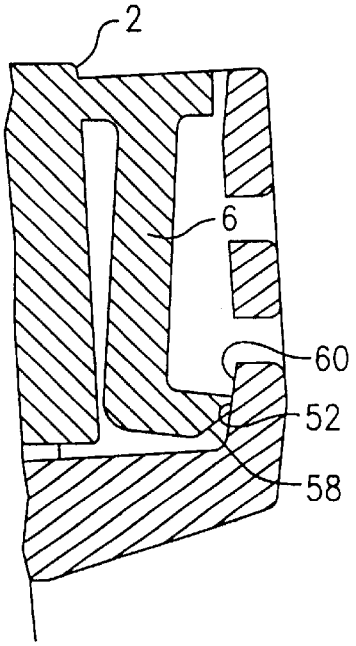

ZERO INSERTION FORCE CONNECTOR FOR FLAT FLEXIBLE CABLE

FIELD OF THE INVENTION

This invention relates to an improved design of Zero Insertion Force (ZIF) connector for connecting flexible circuit cables to contacts of a Printed Circuit Board.

As used herein Flat Flexible Circuit (FFC) should be construed is including Flexible Printed Circuit (FPC)

BACKGROUND OF THE INVENTION

Prior art ZIF connectors have three major weaknesses namely over penetration of the contact into the copper conductors of a flexible circuit cable, dependancy upon a backer (stiffener) for alignment of these conductors, and the lack of strain relief for the connection between the conductors and contacts.

In electrical systems, flexible printed circuits (FFC) are employed as electrical cables for interconnecting rows of terminals of printed circuit boards. Often a connector, mounted to one or both ends of the FFC, has typically been used with a set of electrical receptacles or sockets which are designed to receive terminal posts or contact pads on the printed circuit board.

In today's electronics market, manufacturers are placing emphasis on increasing their product's reliability and reducing assembly costs to remain competitive. A primary focus of each manufacturer is to reduce the cost and increase the circuit density associated with interconnecting the sub-assemblies and components found within its products. Another emerging focus in today's electronics market is to pack more electronic functions into smaller packages. This means higher density modules, each requiring multiple high density interconnections to other modules.

Connector manufacturers have not kept pace with today's market needs. Simply stated, conventional connector technology cannot accommodate today's high-density requirements. Most existing connectors consist of individual stamped contacts assembled into a molded plastic housing. The physical size required to manufacture an acceptable spring contact eliminates this technology in high-density circuits. For the last thirty years, electronic systems have been designed around conventional connector technology. Connector manufacturers have effectively led this market, and system designers gladly followed, because these connectors satisfied their needs. This cannot continue as significant events are combining to change the role of connectors forever, including a new generation of chips that are driving PC board manufacturers to product boards with conductors which have 0.015" or less wide contacts on 0.025" or less centers. These boards must be inter-connected to other modules or to the outside world and will require a high-density connector and interconnect cable.

These key events have led to development of the high-density zero insertion force (ZIF) connector of the present system.

Additionally due to the push towards lower cost FFC (flat flexible cable) and FPC (flexible printed circuits) to PCB (printed circuit board) connector systems, gold over nickel as a plating choice for connector contacts has been out paced by tin/lead. Unfortunately, though cheaper, tin/lead plating develops a non-conductive oxide layer on its surface. Accordingly special connector contact requirements must be met for low voltage/amperage systems. There are three ways to overcome this oxide obstacle to make a good electrical contact:

a) The first is to displace (plow through) the oxide layer using sufficient force and wipe. This is a traditional design, which has been proven for over 30+ years of usage and has industry acceptance and which, when designed and constructed properly, is highly reliable and is a very ergonomic design. However, the high contact force necessary to maintain a gas tight connection physically limits how small the contact (spring) can be made, the minimum wipe movement physically limits how small the connector can be made. The design is also susceptible to fretting, typically has the added part with an associated increased assembly cost of a header or receptacle, and has a low mating cycle life due to wear characteristics;

b) The second is to extrude the soft tin/lead plating through the brittle oxide layer using enormous amounts of contact pressure. This typically does not have the added part and increased assembly cost of a header or receptacle, and does not have very high reliability and resistance to shock, vibration, fretting, etc. Also, the structural integrity of a connector necessary to provide such a high contact force limits the minimum size of the connector, and applies a bending stress on the circuit board; and c) The third is to accurately pierce the oxide layer into the tin/lead but not to the copper trace/lead (more commonly known as a Zero Insertion Force (ZIF) contact system). In this arrangement there is no need for the added part and increased assembly cost of a header or receptacle, there is a high mating cycle life due to very low wear characteristics, the design is not very susceptible to fretting. Also the connector can be made very small because there is no need to compensate for high internal stresses, or mating connectors. However, the cable trace/lead plating thickness is critical because the piercing depth should pass through the surface oxides and into the tin/lead plating but not into the copper due to the potential of copper oxide growth (this is a common failure), and the cable thickness is critical because even though most of the contacts are designed to accommodate for some fluctuation in it, it still affects the depth of piercing.

It is easy to deduce from the aforementioned contact system comparisons that the ZIF contact system should prevail as ideal. This is confirmed by the popularity of ZIF connectors today. However, the design of this contact system type has not been performed ideally. Current ZIF connectors do not limit the insertion depth of their oxide piercing contact. They rely upon the thickness of the cable being a very specific thickness and very tight connector construction tolerances. These limitations and the manufacturing, quality, and cost problems that are associated with them are not suitable for connector Depth Limited Film Piercing Gas Tight Contact System (DFGTS).

Current strain relieving systems for most, if not all, ZIF FFC/FPC connectors are circuit compression/surface friction based. They are comprised of a wedge of some sort driving itself between a wall of the connector housing (which is in the same plane as, but opposite to the contacts( and the backside of a FFC/FPC. This forces the exposed portion of the cable against the contacts. This is the only strain relieving that occurs during a typical ZIF connector in it mated state. The friction generated through the force of the contact against the cable is the only thing stopping the cable and actuator (wedge) from backing out if pulled or if the system is under vibration.

The alignment mechanism is critical. Traditional ZIF connectors align the cable by means of the cable width. The edge of the cable rides against the inside wall of the connector contact cavity. This provides the positioning of the contacts to the cable traces. It also means that the alignment is only as accurate as the tolerance that can be held. The trace to the cable's edge is typically +/−0.005 inches, the contact to the wall connector-housing wall is +/−0.002 inches, which means if all the tolerances are on the high side of a industry standard 0.5 mm ZIF prepared FFC, there could be bridging, and/or cross talk. The ZIF prepared FFC must also have a backer/stiffener added to the backside because, due to the cable's flexible nature it's own dielectric world not provide the stiffness required.

OBJECT OF THE INVENTION

It is an object of the present invention to provide a separable connector system for reliably and releasably connecting the conductive circuit paths of a FFC to closely packed (high density) conductive contacts, connected to a PC board in a way that does not require springs, solder, crimping or welding operations in order to inter-connect the two circuits, the connector system providing accurate registration to ensure reliable desired connection.

A further object is to provide a ZIF connector system which can be formed as an inexpensive structure, is relatively easy and inexpensive to make in quantity and can be mounted to the end of a FFC without requiring any tool and which can be readily connected to and aligned with contacts connected to a PC board.

An object of the invention is also to provide a ZIF connector overcoming the inadequacies of the prior art and to provide a design of DFGTS to mechanically limit the insertion depth of the force concentrator while still allowing it a greater range of deflection than standard contact systems introducing the allowance for wider tolerances on FFC and FPC construction.

SUMMARY OF THE INVENTION

This is achieved by providing a force concentrator for each contact to which the ZIF connector is to be attached. When a trace (conductor) of a FFC or FPC is applied with minimal force to the DFGTS, the force concentrator will pierce only to its height due to the conductor bottoming out on a surface in the housing, thus making it depth limiting. Due to its ultra simple design it can be optimized for offsetting cable incongruities through deflection because it does not have to be designed to take into account additional deflection requirements to make up for a number of manufacturing tolerances due to an overly complicated shape.

The connector of the present invention does not, in a preferred form, rely on the friction type of strain relieving connection. While is does not provide for displacement motion for the cable it also does not rely on the contacts for frictional locking but rather on the penetration of the force concentrator of the contacts through the dielectric of the FFC or FPC into contact with the conductors of the FFC or FPC. The cable may be planarly displaced by the contacts' having a cammed portion instead of using piercing. This would still provide a strain relief but would not pierce the dielectric. This would be important for higher voltage applications. In addition, a contact which has a depth limiting contact bump on the lower beam may be provided, this bump can be plated on, scored in etc. It would be used in connection with the deflection strain relieving method. The ZIF connector of the present invention has ribs to align the cable by its inherently stiffest member, the conductors. Since the conductors fall in-between ribs in the connector housing the entire cable is no longer dependent upon the margins tolerance and edge stiffness of the cable, which eases the cable manufacturing, lowers cable cost and eliminates the added expense of the stiffener backing material. There is also a lower tolerance stack up between the alignment of the contacts and the conductors because they are now being directly aligned by the same physical divider means (ribs). This direct contact to conductor alignment also provides the connector with the additional benefit of isolating the connection points giving positive increases in the performance of the electrical contact and its operating parameters.

The connector also provides positive locked, unlocked and lock release states by the use of locking latches on the outer housing which cooperate with openings and ramps (cam surfaces) in the inner housing to provide visual, audible and tactile indication of the connector status.

The ZIF connector of the present invention provides:

i) Depth Limited Film Piercing Gas Tight Contact System;

ii) Integrated Alignment and Planar Displacement Strain Relieving System;

iii) Specialized Actuators True Locking Snaps with Visual, Audible and Tactile Feedback; and iv) Maintains Competitive Pricing through Design for Easy Manufacturing.

Accordingly the invention provides a zero insertion force (ZIF) connector for connecting a flat flexible cable (FFC) to contacts of a printed circuit board (PCB) comprising a) first and second non-electrically conductive housings which are relatively moveable by a telescopic motion between an unlocked state in which an FFC may be freely inserted into the housings for engagement with the contacts and a locked state in which the conductors of the FFC, when present, are captively engaged in electrical contact with the contacts; and b) a latch system interconnecting the housing to allow telescopic motion of the housings from their unlocked state to their locked state, to retain the housings in their locked state and inhibit separation of housings.

Also provided is a zero insertion force (ZIF) connector for connecting a flat flexible cable (FFC) to contacts of a printed circuit board (PCB) comprising a) first and second non-electrically conductive housings which are relatively moveable by a telescopic motion between an unlocked state in which an FFC may be freely inserted into the housings for engagement with the contacts and a locked state in which the conductors of the FFC, when present, are captively engaged in electrical contact with the contacts; and b) contact and FFC conductor alignment ribs sized and spaced to receive an FFC and to align conductors of the FFC with contacts in the connector for electrical connection of each conductor with an associated contact; wherein the space between each pair of ribs is sized to closely receive a conductor to accurately align the FFC, when present, in the connector and to accurately align the contacts in spaced parallel relationship for alignment with the FFC conductors, when present.

Also provided is a zero insertion force (ZIF) connector for connecting a flat flexible cable (FFC) to contacts of a printed circuit board (PCB) comprising a) first and second non-electrically conductive housings which are relatively moveable by a telescopic motion between an unlocked state in which an FFC may be freely inserted into the housings for engagement with the contacts and a locked state in which the conductors of the FFC, when present, are captively engaged in electrical contact with the contacts; b) a latch system interconnecting the housing to allow telescopic motion of the housings from their unlocked state to their locked state, to retain the housings in their locked state and inhibit separation of housings; and c) contact and FFC conductor alignment ribs sized and spaced to receive an FFC, when an FFC is present, and to align conductors of the FFC with contacts in the connector for electrical connection of each conductor with an associated contact; wherein the space between each pair of ribs is sized to closely receive a conductor to accurately align the FFC, when present, in the connector and to accurately align the contacts in spaced parallel relationship for alignment with the FFC conductors, when present.

Also provided is a method of connecting a flat flexible cable (FFC) with a connector to provide zero insertion force for the FFC, strain relief, and a gas tight electrical connection between conductors of the FFC and electrical contacts of the connector comprising steps of a) providing first and second housings moveable between unlocked and locked states; b) providing a plurality of ribs in the first housing, the ribs defining an entry slot for the FFC and spaces between the ribs to receive and align conductors of the FFC and the contacts; c) providing the contacts with a dielectric penetrating wedge; d) providing an FFC with a connector end having exposed parallel conductors, spaced and sized to fit within and be aligned by the spaces between the ribs, and a dielectric backing supporting the conductors; e) providing a latching system for latching the first and second housings in their unlocked and locked states; f) inserting the connector end of the FFC through the entry slot with the housings in the unlocked state with the conductors of the FFC located by the spaces between the ribs in alignment each with an associated contact; g) moving the housings to their locked state whereby a cam surface causes each dielectric penetrating wedge to penetrate the dielectric into but not through an oxide layer of the underlying conductor just sufficiently to provide good electrical contact with the associated underlying conductor and to provide a gas tight such contact and strain relief for the FFC.

BRIEF DESCRIPTION OF THE DRAWINGS

The invention will now be described, by way of example, with reference to the accompanying drawings, in which:

FIGS. 6–10 correspond to FIGS. 1–5 but with the connector in an unlocked state, the sections of FIGS. 8 and 9 being taken on lines 8—8 and 9—9 of FIG. 6 and the section of FIG. 10 being taken on line 10—10 of FIG. 8, respectively;

FIGS. 11–15 correspond to FIGS. 1–5 but with the connector in an unlatched state, the sections of FIGS. 13 and 14 being taken on lines 13—13 and 14—14 of FIG. 11 and the section of FIG. 15 being taken on line 15—15 of FIG. 13, respectively;

DESCRIPTION OF PREFERRED EMBODIMENT

Figure 1:
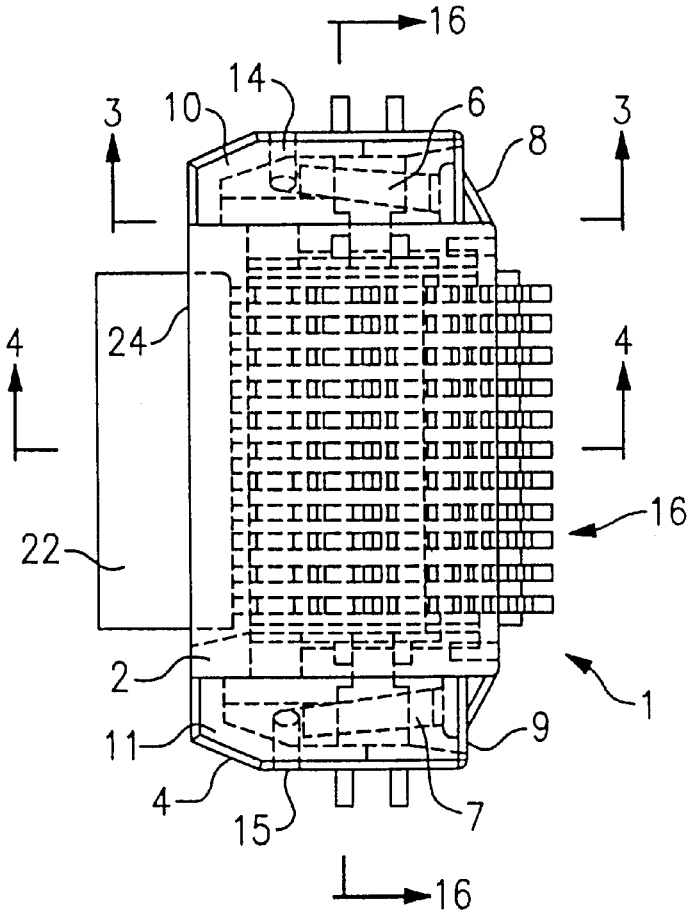
FIG. 1 is a plan view of a ZIF connector of the present invention in a locked state.
Figure 2:
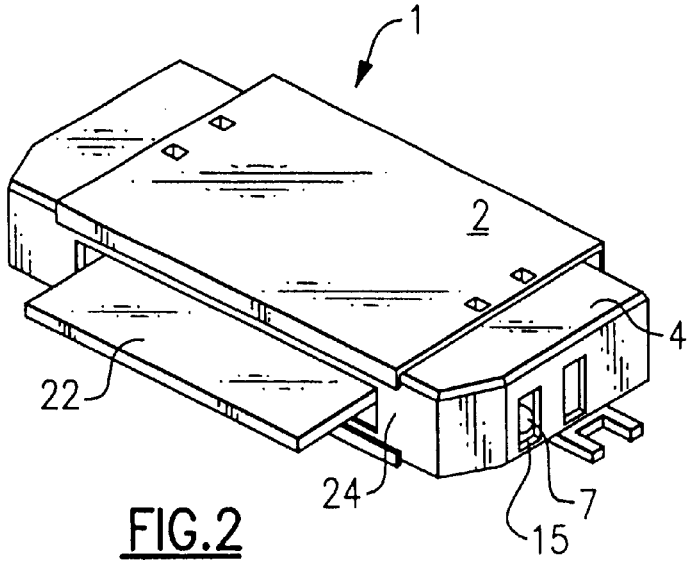
FIG. 2 is a perspective view of the connector of FIG. 1.

Referring firstly to FIGS. 1–5, a ZIF connector 1 is shown in its locked (operative) state with its outer housing 2 closed over its inner housing 4 and latched together by mirror image latches 6, 7 disposed at and fast with opposite ends 8, 9 of the outer housing 2 and extending into cavities 10, 11 at corresponding opposite ends of the inner housing 4 to engage openings 14, 15 to lock the housings 2, 4 together with the locking motion providing visual, audible and tactile indication of a successful locking action.

The housings and latches are injection molded of a polyester preferably "Nylon".

The locked connector houses electrically conductive contacts 16 disposed in spaced parallel relationship each projecting from a separate opening in a contact face 20 of the outer housing 4. A flat flexible cable (FFC) 22 (see FIGS. 17 and 18 and associated description below) extends into a slot 25 formed in a FFC receiving face 24 of inner housing 4 opposite the contact face 20 for engagement with the contacts 16.

Figure 4:
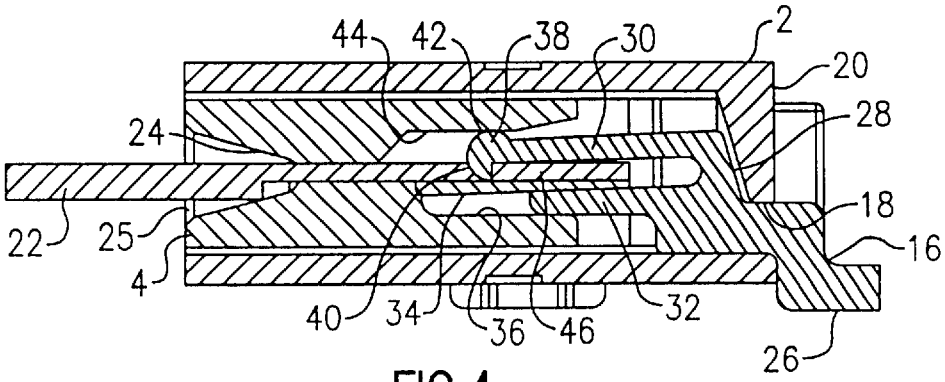
FIG. 4 is a section taken on line 4—4 of FIG. 1.

The contacts 16 each define an outer end 26 for electrically conductive mounting to contact paths or pads of a printed circuit board by e.g. soldering, welding, conductive adhesive, etc. as will be well known to those skilled in the art. The shape of each contact 16 is best seen in FIG. 4. Each contact 16 is constructed from a flat metal member shaped to provide an outer housing abutting surface 28 to retain the contact within the outer housing 2 once the connector has been assembled. Each contact 16 defines parallel arms 30, 32, extending toward the FFC receiving face 22. Arm 32 directly contacts the associated conductor 34 and is supported by a cam surface 36 formed in the inner housing 4. The other arm 30 terminates in a cutting and gripping head 38 having a tapered cutting ridge 40 extending toward the surface 36 and a cam 42 contacting a cam surface 44 wherein when the connector is locked the tapered cutting ridge 40 cuts through the dielectric backing 26 into but not through the oxide layer of the conductor 34 to provide a dielectric piercing gas tight good electrical contact between the contact 16 and the conductor and to provide strain relief for the FFC. The cutting ridge 40 extends toward cam surface 36 only enough for it to penetrate the dielectric backing and the conductor oxide coating with the conductor 34 supported on the lower arm 32 as supported by the cam surface 36. The taper of the ridge 40 is chosen to closely engage the dielectric backing of the FFC to provide the gas tight aspect of the connection with contact 16.

The latch arrangements 6, 10, 14 and 7, 11, 15, are identical mirror images of one another and, therefore, only the arrangement 6, 10, 14 will be described in detail here.

Figure 3:
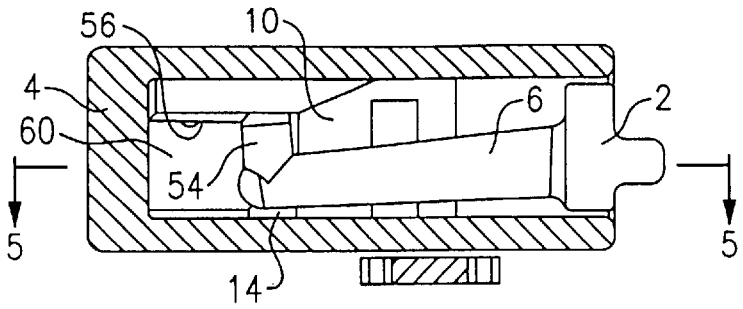
FIG. 3 is a section taken on line 3—3 of FIG. 1.
Figure 5:
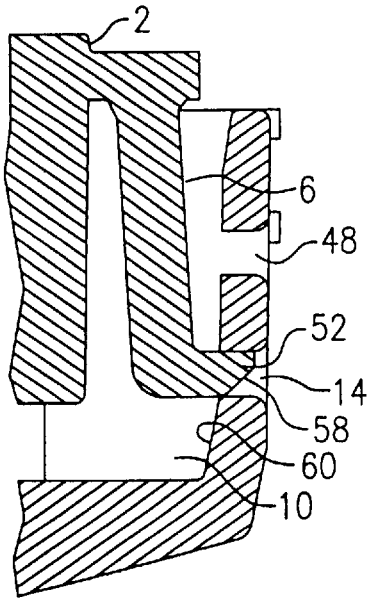
FIG. 5 is a fragmentary section taken on line 5—5 of FIG. 3.
Figure 6:
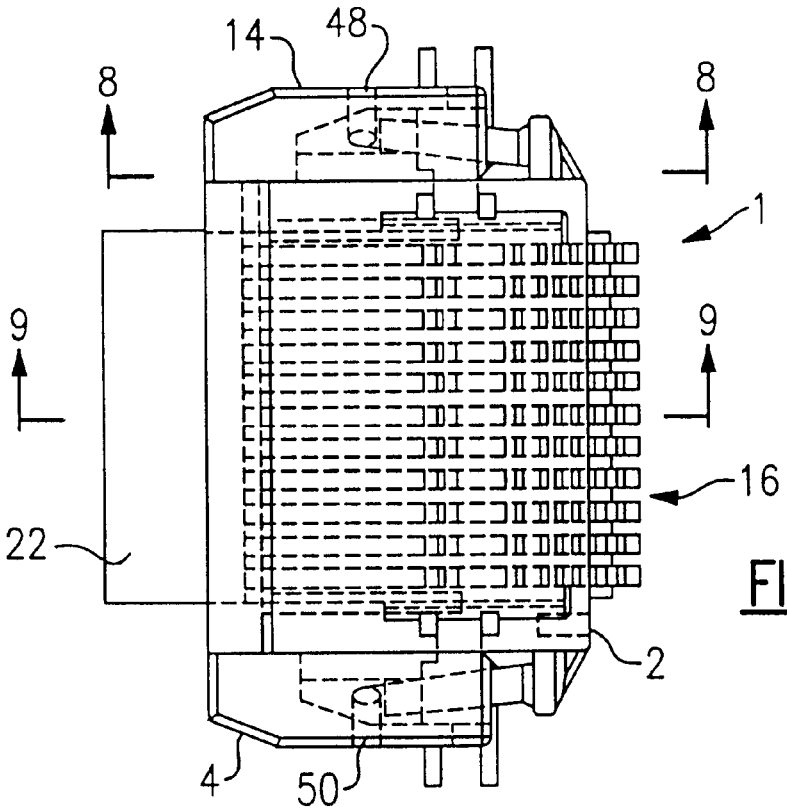
Figure 7:
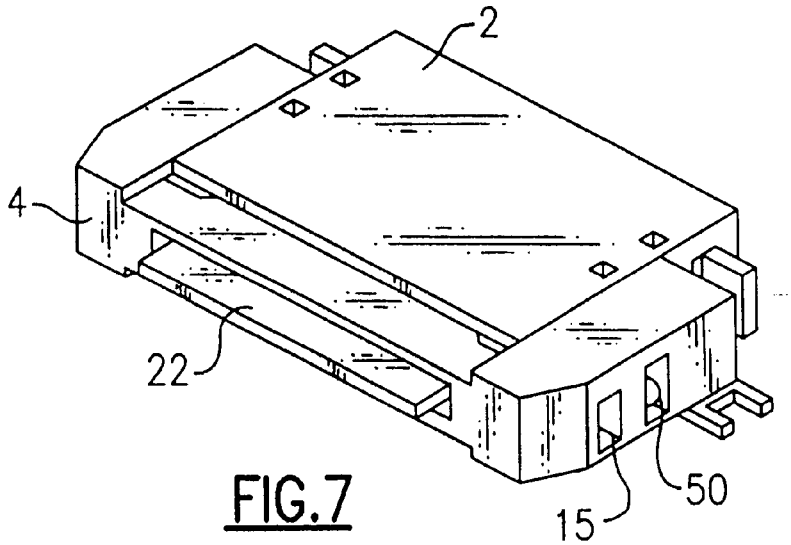
Figure 11:
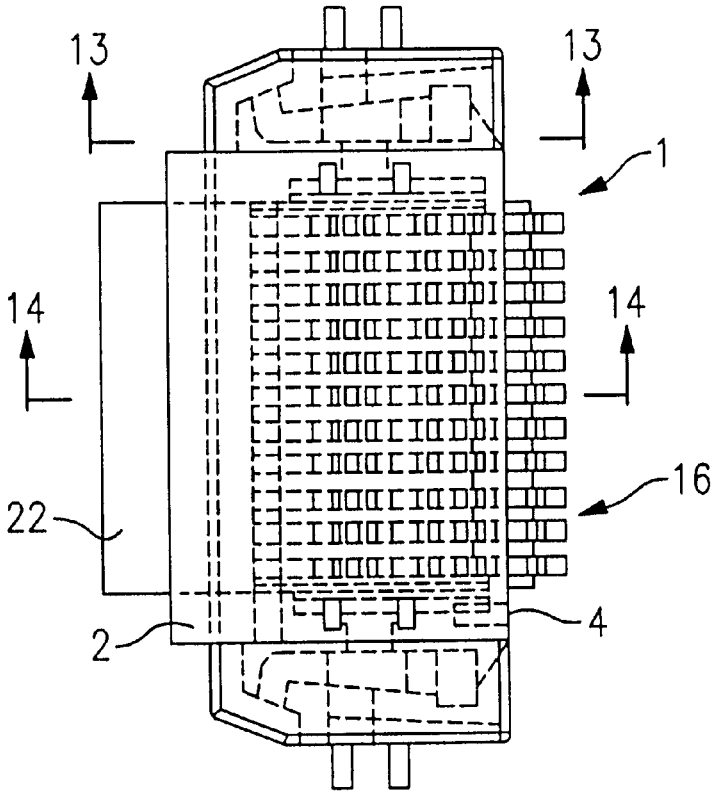
Figure 12:
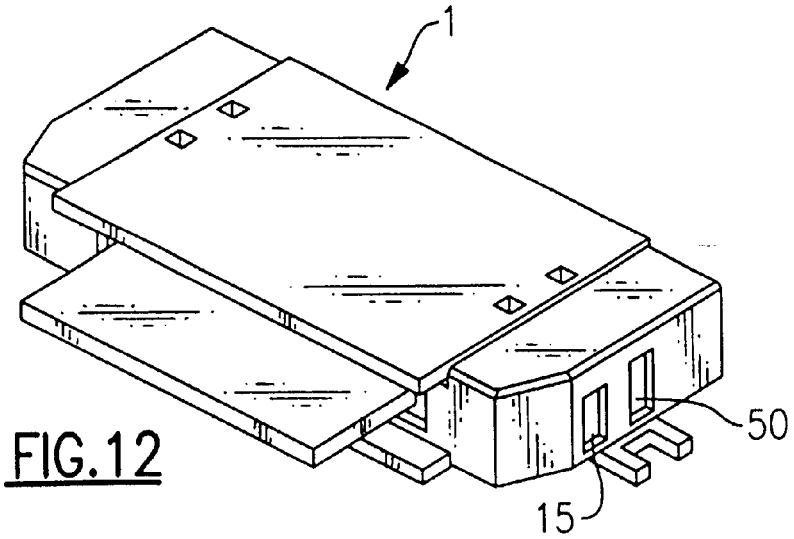

Referring to FIGS. 3 and 5, the latch 6 is an elongate rod integrally formed with or otherwise fast with the outer housing 2 from which it extends into the cavity 10 to its termination by an opening engaging detent 52 shaped to prevent, except as described later, the connector from being unlocked once the detent engages the opening 14. This engagement is assured by a resilient bias of the latch toward such engagement. As seen in FIG. 3 the terminal end of the latch also defines a projection 54 which, when the connector is locked (as shown in FIG. 3), engages a guide surface 56 to resiliently bias the latch 6 downwardly (as seen in FIG. 3) while still allowing the detent 52 to engage the opening 14 to lock the housings 2, 4 together in their locked state. The detent 52 is provided with a relief 58 to allow the detent to move beyond this locked state and to engage a sloping cam surface 60 to place the connector into an unlatched state as will be described below.

FIGS. 6–10 illustrate the connector 1 in an unlocked state with the detents of the latches 6, 7 engaging openings 48, 50 respectively to prevent disassembly of the housings 2, 4 from one another while permitting assembly of a FFC 22 to the contacts 16 and the relative movement of the housings to the locked state shown in FIGS. 1–5. Referring in particular to FIGS. 9*a* and 9*b*, the assembly of the FFC 22 to the contacts 16 is shown using one conductor and one contact as an example of what happens simultaneously to all of the FFC conductors and their associated contacts. In FIG. 9*a* the FFC 22 is being inserted and has just reached the contact 16 while the arm 32 and cam 42 of arm 30 have yet to contact the respective associated cam surfaces 36 and 44 which are formed on the inner housing 4. FIG. 9*b* shows a slightly more advanced stage of assembly in which the connector end of the FFC has been advanced part way between the arms 30, 32 and the cam 40 or arm 30 has just contacted a sloping cam surface 62 leading to surface 44. This sloping surface 62 facilitates the cutting of ridge 40 through the dielectric 46 of the FFC with the cooperation of the arm 32 on the cam surface 36 as the housings 2, 4 are telescoped into the fully assembled locked state shown in FIGS. 1–5.

As will be seen from FIG. 8 the cam follower 54 has been released from cam surface 56 as the detent is moved from the locked to unlocked status of the connector and has thus returned to an orientation in which it is only resiliently biased to engage the detent 52 in opening 48.

The inner housing 2 provides an inner guide slot 64 to guide the FFC through the inner housing 4 to the space between the arms 30, 32 of the contacts 16.

It will be noted that in the positions of the housings 2, 4 of FIG. 9*b* the detents will already be leaving openings 48, 50 by virtue of the reliefs as the housings begin to move toward the locked state.

As previously mentioned the detent 52 is provided with a relief 58. This allows the detent of move beyond this locked state and to engage a sloping cam surface 60 to place connector into an unlatched state as now described.

FIGS. 11–15 illustrate the connector 1 in an unlatched state with the detents of the latches 6, 7 pushed past the openings 48, 50 to engage the sloping cam surface 60 to bias the cam follower 54 to release it from the cam surface 56 and engage the side surface 66 in which condition resilient bias of the detent 52 into engagement with the opening 14 is prevented. The detent 52 in this condition can bypass opening 14 following which continued movement toward the unlocked state of the connector will release the detent 52 from side surface 66 and allow the detent to engage opening 48 with the connector then again being in its unlocked state.

As in FIG. 4, FIG. 14 shows the contact 16 and FFC 22 fully engaged when the connector was in its locked state even though the housings are now unlatched.

As will be seen from FIG. 8 the cam follower 54 has been released from cam surface 56 as the detent is moved from the locked to unlocked status of the connector and has thus returned to an orientation in which it is resiliently biased to engage the detent 52 with the opening 48.

Figure 16:
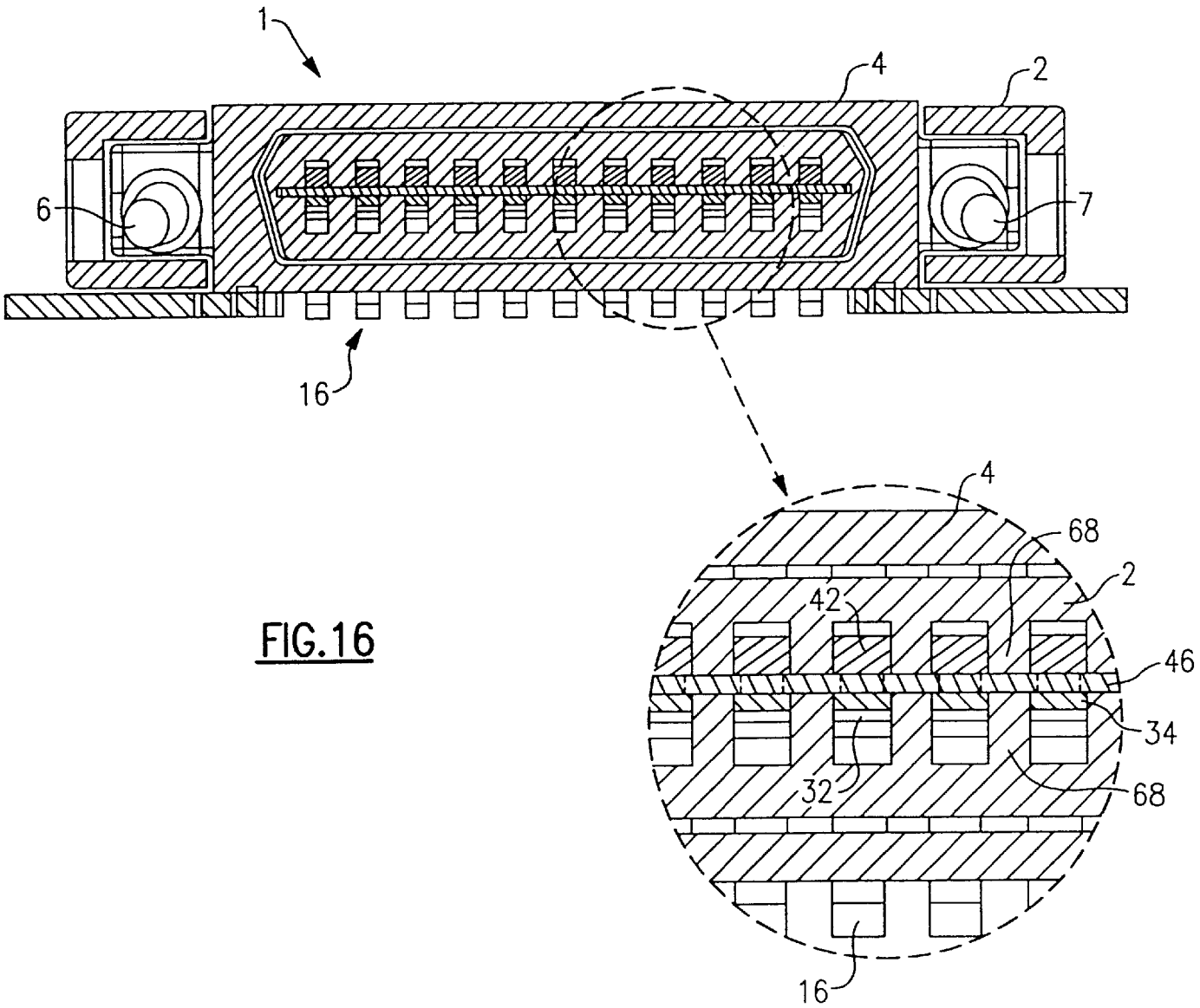
FIG. 16 is a section taken on line 16—16 of FIG. 1 with a portion thereof shown on greater scale in an associated dashed circle.
Figure 17:
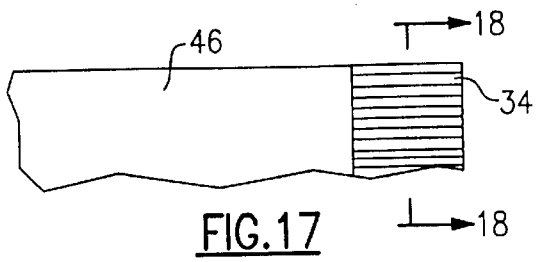
FIG. 17 is fragmentary plan view of the connector end of a FFC.
Figure 18:
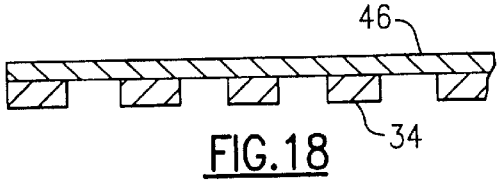
FIG. 18 is a fragmentary section taken on line 18—18 of FIG. 17.

Referring now to FIG. 16 a cross-section of the connector 1 as shown by line 16—16 of FIG. 1 looking toward the contacts 16 while FIGS. 17 and 18 a diagrammatically illustrate the connector end of an FFC. The inner housing defines a plurality of contact and conductor spacing ribs 68 sized and spaced to accurately align the conductors 34 of the FFC 22 with the contacts 16 to ensure good electrical connection between each of conductor and associated contact while ensuring good electrical isolation between adjacent associated pairs and all other such associated pairs. The slot 64 is dimensioned to ensure that the conductors 34 extend into the spaces between ribs 68 thereby ensuring the desired alignment. As previously mentioned a guide slot 64 is defined by ribs 68 to guide the FFC 22 into the connector 1 in alignment with the contacts 16. Thus the edges of the FFC are not used for alignment.

As seen in FIGS. 17 and 18 the dielectric material is absent from one surface of the connector end of the FFC leaving a plurality of parallel separate conductors 34 supported only by a dielectric backing 26 and spaced to provide for alignment within the connector 1 by the ribs 68. Typically the conductors and spaced 0.0196 inches on center and are 0.011 inches wide. The connector itself has, e.g. 11 contacts and is 0.465 inches wide, 0.187 inches long and 0.074 inches thick.

Figure 19:
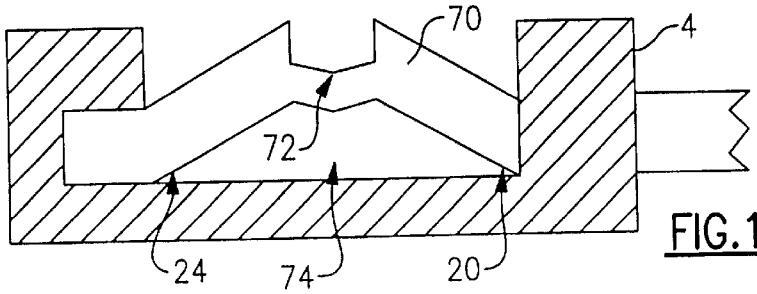
FIGS. 19–21 are diagrammatic illustrations of a self-aligning circuit retaining actuator/holder for possible use with the ZIF connector of the present invention.
Figure 20:
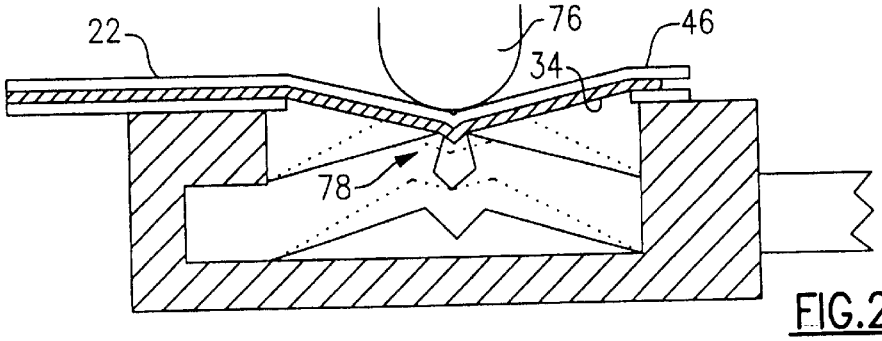
Figure 21:
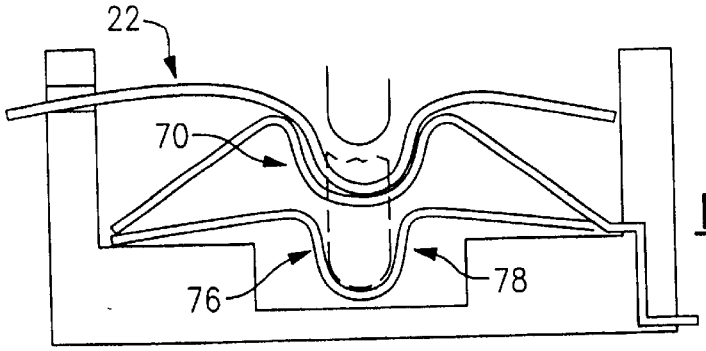

Referring now to FIGS. 19–21 an alternative contact design comprises a conductor gripping spring contact 70 of a lazy V or U configuration 72 is illustrated for possible use between the ribs 68 on the conductor 34 side of the connector end of the FFC to grip the conductor located by the associated ribs 68 in a pinching action when activated. Both ends of the spring are firmly located in the inner housing 4 between the receiving face 24 and contact face 20 and are suspended over a deflection trough 74. Of course, a spring contact 70 is provided for each conductor 34. An actuator 76 is moved into contact with the FFC as the connector is moved to a locked state, depressing the spring contact downwardly and thereby closing the lazy V or U to pinch the associated conductor 34 at 78 to establish good electrical contact and provide strain relief for the FFC. FIG. 21 shows the unlocked and locked states of the connector with such an arrangement.

REFERENCE NUMBERS

1 ZIF connector
2 outer housing
4 inner housing
6 latch
7 latch
8 opposite end
9 opposite end
10 cavity
11 cavity
14 opening
15 opening
16 contacts
18 openings
20 contact face
22 FFC
24 receiving face
25 receiving slot
26 outer end
28 abutting surface
30 arm
32 arm
34 conductor
36 cam surface
38 head
40 ridge
42 cam follower
44 cam surface

35 dielectric backing
38 opening
50 opening
52 detent
54 cam follower
56 guide surface
58 relief
60 sloping cam surface
62 sloping cam surface
64 guide slot
66 side surface
68 ribs
70 spring contact
72 lazy V or U
74 trough
76 actuator
78 pinch

What is claimed is:

1. A zero insertion force (ZIF) connector for connecting conductors of a flat flexible cable (FFC) to contacts of a printed circuit board (PCB) comprising a) first and second non-electrically conductive housings which are relatively moveable by a telescopic motion between an unlocked state in which an FFC may be freely inserted into the housings for engagement with the contacts and a locked state in which the conductors, when present, are captively engaged in electrical contact with the contacts; and b) a latch system interconnecting the housings to allow telescopic motion of the housings from their unlocked state to their locked state, to retain the housings in their locked state and inhibit separation of the housings; wherein when the housings are in their locked state the relative telescopic movement of the housings is permitted beyond, relative to their unlocked state, the locked state to an unlatched state in which the housings are free to move telescopically back to their unlocked state.

2. The connector of claim 1, wherein the latch system comprises a latch, fast with one of the housings, having a detent to engage openings in the other of the housings to retain the housings in their locked and unlocked states and cam surfaces are provided to engage the latch to permit movement of the latch to the unlatched state thereby to permit the detent to bypass the locked state and to allow the latch to return to the unlocked state of the housings with the detent engaging opening associated with the unlocked state.

3. The connector of claim 2 wherein the latch is resiliently biased to engagement with the openings and operates to provide visual, audible and tactile feedback of latch operation.

4. The connector of claim 2 wherein the detent has a relief to permit the telescopic movement of the housings from their unlocked state to their locked state and from the locked to their unlatched state.

5. The connector of claim 1 wherein the first and second housings together define a contact receiving face, an FFC receiving face opposite the contact receiving face and opposed ends each having a said latch system, the latch systems being a mirror image of one another.

6. A zero insertion force (ZIF) connector for connecting conductors of a flat flexible cable (FFC) to contacts of a printed circuit board (PCB) comprising a) first and second non-electrically conductive housings which are relatively moveable by a telescopic motion between an unlocked state in which an FFC may be freely inserted into the housings for engagement with the contacts and a locked state in which the conductors when present, are captively engaged in electrical contact with the contacts; and b) contact and FFC conductor alignment ribs sized and spaced to receive an FFC and to align conductors of the FFC with contacts in the connector for electrical connection of each conductor with an associated contact; wherein the space between each pair of ribs is sized to closely receive a conductor to accurately align the FFC, when present, in the connector and to accurately align the contacts in spaced parallel relationship for alignment with the FFC conductors, when present, and when the housings are in their locked state the relative telescopic movement of the housings is permitted beyond, relative to their unlocked state, the locked state to an unlatched state in which the housings are free to move telescopically back to their unlocked state.

7. The connector of claim 6 wherein the first housing defines the ribs and the contacts extend through individual openings in a contact receiving face of the second housing, each contact comprises a connection forming arm extending into the housings away from the contact receiving face and terminating in a ridge projection having a cutting edge, the first housing defines a cam surface which as the housings are telescoped from their unlocked state to locked state force the cutting edge of the ridge projection through a dielectric backing of an FFC, when present, into an oxide coating of conductor of that FFC and to provide a gas tight electrical contact with the conductor through the dielectric.

8. The connector of claim 7 wherein each contact defines a conductor support arm parallel with the connection forming arm, the FFC, when present, being received between the arms, the conductor arm being supported by a surface of the first housing, when the housings are in their locked state, thereby to support the associated conductor of the FFC, when present, for controlled penetration of the knife edge ridge member through the dielectric of the FFC, when present.

9. The connector of claim 8 further comprising an FFC having a connector end having a dielectric backing and a parallel plurality of exposed conductors, the connector end being freely insertable into the housings when in their unlocked state and held captive with each knife edged ridge member penetrating the dielectric into contact with an oxide layer of an associated conductor to provide electrical contact between associated conductors and contacts and strain relief for the FFC.

10. A zero insertion force (ZIF) connector for connecting conductors of a flat flexible cable (FFC) to contacts of a printed circuit board (PCB) comprising a) first and second non-electrically conductive housings which are relatively moveable by a telescopic motion between an unlocked state in which an FFC may be freely inserted into the housings for engagement with the contacts and a locked state in which the conductors, when present, are captively engaged in electrical contact with the contacts;

b) a latch system interconnecting the housing to allow telescopic motion of the housings from their unlocked state to their locked state, to retain the housings in their locked state and inhibit separation of housings; and c) contact and FFC conductor alignment ribs sized and spaced to receive an FFC, when an FFC is present, and to align conductors of the FFC with contacts in the connector for electrical connection of each conductor with an associated contact; wherein the space between each pair of ribs is sized to closely receive a conductor to accurately align the FFC, when present, in the connector and to accurately align the contacts in spaced parallel relationship for alignment with the FFC conductors, when present, and when the housings are in their locked state the relative telescopic movement of the housings is permitted beyond, relative to their unlocked state, the locked state to an unlatched state in which the housings are free to move telescopically back to their unlocked state.

11. The connector of claim 10 wherein the latch system comprises a latch, fast with one of the housings, having a detent to engage openings in the other of the housings to retain the housings in their locked and unlocked states and cam surfaces are provided to engage the latch to permit movement of the latch to the unlatched state thereby to permit the detent to bypass the locked state and to allow the latch to return to the unlocked state of the housings with the detent engaging opening associated with the unlocked state.

12. The connector of claim 11 wherein the latch is resiliently biased to engagement with the openings and operates to provide visual, audible and tactile feedback of latch operation.

13. The connector of claim 11 wherein the detent has a relief to permit the telescopic movement of the housings from their unlocked state to their locked state and from the locked to their unlatched state.

14. The connector of claim 10 wherein the first and second housings together define a contact receiving face, an FFC receiving face opposite the contact receiving face and opposed ends each having a said latch system, the latch systems being a mirror image of one another.

15. The connector of claim 10 wherein the first housing defines the ribs and the contacts extend through individual openings in a contact receiving face of the second housing, each contact comprises a connection forming arm extending into the housings away from the contact receiving face and terminating in a ridge projection having a cutting edge, the first housing defines a cam surface which as the housings are telescoped from their unlocked state to locked state force the cutting edge of the ridge projection through a dielectric backing of an FFC, when present, into an oxide coating of a conductor of that FFC and to provide a gas tight electrical contact with the conductor through the dielectric.

16. The connector of claim 15 wherein each contact defines a conductor support arm parallel with the connection forming arm, the FFC, when present, being received between the arms, the conductor arm being supported by a surface of the first housing, when the housings are in their locked state, thereby to support the associated conductor of the FFC, when present, for controlled penetration of the knife edge ridge member through the dielectric of the FFC, when present.

17. The connector of claim 16 further comprising an FFC having a connector end having a dielectric backing and a parallel plurality of exposed conductors, the connector end being freely insertable into the housings when in their unlocked state and held captive with each knife edged ridge member penetrating the dielectric into contact with an oxide layer of an associated conductor to provide electrical contact between associated conductors and contacts and strain relief for the FFC.

18. A method of connecting a flat flexible cable (FFC) with a connector to provide zero insertion force for the FFC, strain relief, and a gas tight electrical connection between conductors of the FFC and electrical contacts of the connector comprising steps of:

a) providing first and second housings telescopically moveable between unlocked and locked states and when the housings are in their locked state, permitting telescopic movement of the housing beyond, relative to their state, the locked state to an unlatched state in which the housing are free to move telescopically back to their unlocked state;

b) providing a plurality of ribs in the first housing, the ribs defining an entry slot for the FFC and spaces between the ribs to receive and align conductors of the FFC and the contacts;

c) providing the contacts with a dielectric penetrating wedge;

d) providing an FFC with a connector end having exposed parallel conductors, spaced and sized to fit within and be aligned by the spaces between the ribs, and a dielectric backing supporting the conductors;

e) providing a latching system for latching the first and second housings in their unlocked and locked states;

f) inserting the connector end of the FFC through the entry slot with the housings in the unlocked state with the conductors of the FFC located by the spaces between the ribs in alignment each with an associated contact;

g) moving the housings to their locked state whereby a cam surface causes each dielectric penetrating wedge to penetrate the dielectric into but not through an oxide layer of the underlying conductor just sufficiently to provide good electrical contact with the associated underlying conductor and to provide a gas tight such contact and strain relief for the FFC.

* * * * *